United States Patent [19]

Madgavkar et al.

[11] 4,378,048

[45] Mar. 29, 1983

[54] SUBSTOICHIOMETRIC COMBUSTION OF LOW HEATING VALUE GASES USING DIFFERENT PLATINUM CATALYSTS

[75] Inventors: Ajay M. Madgavkar, Irvine, Calif.; Harold E. Swift, Gibsonia, Pa.

[73] Assignee: Gulf Research & Development Company, Pittsburgh, Pa.

[21] Appl. No.: 261,746

[22] Filed: May 8, 1981

[51] Int. Cl.[3] ..... F21B 43/24

[52] U.S. Cl. ..... 166/256; 166/266; 423/247; 423/245

[58] Field of Search ..... 166/256, 266, 267; 423/245 S, 247

[56] References Cited

U.S. PATENT DOCUMENTS

| | | | |
|---|---|---|---|
| 1,919,626 | 7/1933 | Finn, Jr. | 423/247 X |
| 3,342,545 | 9/1967 | Jaeger | 423/245 S |
| 3,544,264 | 12/1970 | Hardison | 423/245 S X |
| 3,988,423 | 10/1976 | Ohrui et al. | 423/245 S X |
| 4,186,801 | 2/1980 | Madgavkar et al. | 166/256 |
| 4,191,733 | 3/1980 | Swift et al. | 423/245 S X |
| 4,250,962 | 2/1981 | Madgavkar et al. | 166/256 |
| 4,273,188 | 6/1981 | Vogel et al. | 166/256 |

FOREIGN PATENT DOCUMENTS

| | | | |
|---|---|---|---|
| 51-89869 | 8/1976 | Japan | 423/247 |

OTHER PUBLICATIONS

Andersen et al., "Removing Carbon Monoxide from Ammonia Synthesis Gas", *Industrial and Engineering Chemistry,* vol. 53, No. 8, Aug. 1961, pp. 645, 646.

*Primary Examiner*—James A. Leppink
*Assistant Examiner*—George A. Suchfield
*Attorney, Agent, or Firm*—Deane E. Keith; Forrest D. Stine; Donald L. Rose

[57] ABSTRACT

Low heating value gases are combusted substoichiometrically in two combustion zones in series in contact with two different supported platinum catalysts in which the concentration of platinum in the catalyst in the first zone is higher than the concentration of platinum in the second catalyst. The combusted gas of reduced carbon monoxide can be directly vented to the atmosphere after energy has been extruded from it for a useful purpose.

6 Claims, No Drawings

SUBSTOICHIOMETRIC COMBUSTION OF LOW HEATING VALUE GASES USING DIFFERENT PLATINUM CATALYSTS

SUMMARY OF THE INVENTION

This invention relates to the catalyzed combustion of combustible gases of low heat content using less than a stoichiometric amount of oxygen. More particularly, this invention relates to the substoichiometric combustion of low heating value gases containing hydrogen sulfide under catalytic conditions that substantially minimize the amount of carbon monoxide in the product gas. In this process the low heating value gas is combusted in two stages utilizing an oxidation catalyst comprising platinum in each stage in which the concentration of platinum is higher in the first stage than it is in the second stage in order to attain a lower light-off temperature, a lower content of carbon monoxide in the product and a higher catalyst resistance to sulfur poisoning.

DETAILED DESCRIPTION OF THE INVENTION

Low heating value gas streams, such as waste gas streams and by-product gas streams, have traditionally been discharged to the atmosphere. In recent years a greater knowledge and concern about atmospheric pollution had led to legal standards controlling the direct emission to the atmosphere of gases containing significant amounts of hydrocarbons and/or carbon monoxide. In order to avoid atmospheric pollution, the hydrocarbons and carbon monoxide in a waste gas stream of low heating value are completely combusted with a stoichiometric excess of oxygen for direct venting to the atmosphere. However, in recognition of the fact that a large amount of energy is contained in a large volume of low heating value gas, it has been suggested that the energy loss be reduced by recovering heat energy from the fully combusted gas in a boiler or in a turbine before venting the combusted gas to the atmosphere. In addition to waste and by-product gases, low heating value gases can be intentionally produced for combustion and energy recovery such as in the underground partial combustion and gasification of difficult-to-mine coal deposits.

In contrast with complete combustion of a low heating value gas, catalytically combusting a dilute gas stream of low heating value with an insufficient, that is a substoichiometric, amount of air cannot result in a complete elimination of the combustible components. The utilization of substoichiometric combustion of a low heating value gas may be desirable in certain circumstances, such as, for example, when the composition of the gas and therefore its heat content varies with time. The use of a constant substoichiometric amount of air for combustion results in a constant temperature in both the combustion zone and in the exiting combusted gas notwithstanding the variation in the heat content of the low heating value gas. The constant temperature in the combustion zone avoids catalyst damaging cycles of thermally induced expansion and contraction, which can be a significant problem, particularly when large catalyst structures are required to handle very large volumes of low heating value gas. Furthermore, this combusted gas of constant temperature can be used to drive a gas turbine, without expansion-contraction damage to the turbine blades, which protection is necessary, in particular, with gas turbines which are designed for constant temperature operation. However, the production of substantial quantities of carbon monoxide is a significant problem in the substoichiometric combustion of low heating value, hydrocarbon-containing gas streams.

In the substoichiometric combustion of a low heating value gas using a supported platinum catalyst, it has been discovered that the carbon monoxide level in the product gas stream varies with the platinum content of the catalyst, the lower the platinum content the lower the proportion of carbon monoxide in the product. However, it has also been determined that the light-off temperature decreases with an increasing amount of platinum and that the catalyst's tolerance to hydrogen sulfide is enhanced with an increasing amount of platinum. Low carbon monoxide levels in the product gas, low light-off temperatures and good catalyst sulfur tolerance are all desirable results.

We have discovered that low heating value gas streams that contain a significant amount of hydrogen sulfide can be subjected to a substoichiometric combustion procedure designed for superior catalytic activity, lower light-off temperature, improved tolerance to hydrogen sulfide and reduced carbon monoxide in the product gas. Our combustion procedure involves sequential combustion of the low heating value gas in two separate combustion zones over two distinct and different platinum catalysts in which the amount of platinum in the catalyst in the first combustion zone is significantly greater than the amount of platinum in the catalyst in the second combustion zone.

Light-off temperature is defined as the minimum inlet temperature to which the low heating value gas stream must be heated to maintain steady state combustion over the oxidation catalyst. It is self-evident that having a reduced light-off temperature is advantageous. We obtain a lower light-off temperature in our process by using a higher platinum content catalyst in the first stage, thereby requiring less heating of the feed gas for first stage combustion. Furthermore, in our process the hydrogen sulfide is oxidized to sulfur dioxide in the first stage over the more sulfur tolerant, higher platinum content catalyst. Since sulfur dioxide is not a significant catalyst poison, its presence in the feed to the second stage is not a problem to the less hydrogen sulfide tolerant, lower platinum content catalyst. In our process, the product from the first stage partial combustion contains a relatively high carbon monoxide content because of the relatively high level of platinum used in the frist stage catalyst. However, this carbon monoxide content is substantially reduced in the second stage substoichiometric combustion by the lower platinum content, second stage catalyst.

The substoichiometric combustion as carried out in our process is defined by the air equivalence ratio, or A.E.R. As used herein, air equivalence ratio is the ratio of the amount of air used in the partial combustion to the amount of air required at the same conditions of pressure and temperature for stoichiometric combustion of all combustible components in the gas stream (the denominator of this ratio being 1.0 is not expressed).

We have found that a significant reduction in carbon monoxide in the product gas is obtained with a catalyst of reduced platinum content when the low heating value gas is combusted at an intermediate, substoichiometric air equivalence ratio. Thus, within an A.E.R.

range of between about 0.45 and about 0.8 a catalyst containing 0.3 percent platinum produced a product gas of noticeably lower carbon monoxide content that a catalyst containing 0.5 percent platinum. The specific range of air equivalence ratios in which different carbon monoxide levels are obtained may vary with other combinations of platinum content of the two different catalysts used in the two combustion zones and/or the ranges of A.E.R. ratios may vary with variations in gas composition. Therefore, for any particular combination of catalysts utilized in the two combustion zones, the overall benefits of lower light-off temperature, sulfur tolerance and carbon monoxide reduction are obtained when the overall air equivalence ratio utilized in the process lies within the range in which a difference in carbon monoxide content would result from the separate use of each combustion catalyst.

The above-described benefits in the substoichiometric combustion of the sulfur-containing, low heating value gas streams are in general obtained when the overall air equivalence ratio is at least about 0.30 and preferably at least about 0.40 with a maximum of about 0.80 and preferably a maximum of about 0.75. When the heat content of the gas stream varies with time, the combustion will generally be within these ranges for a substantial portion of the time that the combustion is taking place while using a substantially constant substoichiometric supply of air. The A.E.R. of a gas of fluctuating heat content is based on the average heating value of the gas over one or more fluctuations.

In order to obtain the benefits of our invention with gas streams of various compositions and from various sources, the ratio of the amount of platinum in the first stage catalyst to the amount of platinum in the second stage catalyst can be between about 1.2:1 and about 20:1, but preferably this ratio will be between about 1.5:1 and about 10:1. Furthermore, the supported catalyst in the first stage can itself broadly contain from about 0.2 to about ten weight percent platinum with a preferred range being between about 0.5 and about five percent platinum. The supported catalyst in the second stage can broadly contain between about 0.05 and about five weight percent platinum and preferably it will contain between about 0.1 and about one percent platinum.

It is not necessary that each catalyst consist only of platinum. For example, the catalyst in the second stage can also contain cocatalysts such as described in U.S. Pat. No. 4,191,733 for further enhanced carbon monoxide reduction. The solid cocatalyst, as described, is selected from Groups IIA and VIIB, Group VIII up through atomic No. 46, the lanthanides, chromium, zinc, silver, tin and antimony. In this catalyst combination a mol ratio of cocatalyst as the oxide to platinum as the metal of between about 0.1:1 and about 100:1 can be useful but preferably the ratio of these components will be between about 0.5:1 and about 50:1.

In substoichiometric combustion, carbon monoxide may result from one or more reaction mechanisms such as the partial oxidation of the hydrocarbon, the reverse water gas shift reaction $CO_2+H_2 \rightleftarrows CO+H_2O$, or the steam reforming reaction $CH_4+H_2O \rightleftarrows CO+3H_2$. We believe that the reduction in carbon monoxide obtained by our process results from a favorable shift in one or more of these reactions in a direction away from carbon monoxide.

The gas stream undergoing substoichiometric combustion can also contain arsine for enhanced reduction of carbon monoxide as described in our U.S. patent application Ser. No. 161,857, filed June 23, 1980. The arsine content should be at least about 0.1 ppm and preferably at least about 0.2 ppm to effect a noticeable reduction in carbon monoxide with a maximum content of about 50 ppm arsenic and preferably about 10 ppm. The use of arsine can be in addition to or as an alternative to the use of the solid cocatalyst.

We find that the present process is suitable for combustion of low heating value gas streams having a heating value as low as about 15 Btu/scf (one British thermal unit per standard cubic foot at atmospheric pressure and 60° F., 15.6° C., equals 9.25 kilocalories per cubic meter) but we prefer that the heating value of the gas stream be at least about 30 Btu/scf. The maximum heating value of the gas stream undergoing combustion by our process broadly is about 200, more generally a maximum of about 150, and most likely contains a maximum of about 100 Btu/scf. Frequently the heating value of the gas fluctuates with time as measured in minutes, hours, days or longer. In the case of gas streams of fluctuating heating value, the heating value specified above means the average heating value over one or more cycles of fluctuation.

There are many types and sources of low heating value gases which can advantageously be combusted by our process, including those low heating value gases which are waste gases as well as those low heating value gases which are intentionally produced. Thus, low heating value gas streams predominating in hydrocarbon combustibles are produced as the liquids-free by-product flue gas obtained from the subterranean in situ combustion processes for the recovery of hydrocarbons from carbonaceous deposits such as petroleum reservoirs, tar sands, oil shale formations, and the like. Or a low heating value gas stream can itself be produced as the primary product such as the low heating value gas stream resulting from the underground combustion of difficult-to-mine coal deposits. The low heating value gas stream can also be either intentionally produced in a factory operation or it can be a factory waste gas stream including synthesis and producer gas; blast furnace gas; waste gases resulting from phosphorus furnaces; from various metallurgical and chemical manufacturing; and the like.

In view of the great variety of sources, the low heating value gas may contain hydrocarbons as its primary combustible component such as those gas streams resulting from the in situ combustion of petroleum reservoirs, tar sands or oil shale formations. Alternatively, the primary combustible component can be carbon monoxide and hydrogen which is the case with synthesis gas and the gas streams resulting from underground coal gasification. Or both hydrogen and hydrocarbons or these two plus carbon monoxide can be present in significant amounts. In general, the present process is directed to those low heating value gas streams containing a significant proportion of their fuel value as either hydrocarbons, carbon monoxide or both, and up to about 50 mol percent hydrogen.

The hydrocarbon fraction present in these gas streams can have individual hydrocarbons with up to about seven carbon atoms in their molecule with methane generally being the predominant hydrocarbon. When a mixture of dilute gaseous hydrocarbons is burned in a deficiency of air, the higher hydrocarbons burn most readily while the lower the number of carbon atoms in the molecule the more resistant to combustion is the hydrocarbon. As a result methane is the primary unburned component in a partially combusted mixture of gaseous hydrocarbons. This is fortuitous since methane is not regarded as a pollutant when discharged into the atmosphere in moderate amounts.

As pointed out above, the present process is particularly advantageous when the low heating value feed gas stream undergoing substoichiometric combustion contains hydrogen sulfide because the higher platinum content first stage catalyst is not only more tolerant of hydrogen sulfide but also the higher platinum content reduces the light-off temperature as compared with the second stage catalyst. This reduction in light-off temperature is particularly desirable to counter, at least in part, the elevation in light-off temperature caused by the presence of hydrogen sulfide in the low heating value gas stream. This elevation in light-off temperature is observed in feed streams containing 200–400 and more ppm of hydrogen sulfide. The amount of hydrogen sulfide in the waste gas stream is desirably no more than about two weight percent and preferably a maximum of about 0.5 weight percent.

In combusting this low heating value gas and air mixture, it must be heating to its combustion or light-off temperature prior to contacting the gas with the first stage catalyst. The light-off temperature depends on the particular composition of the gas, as well as on the concentration of platinum on the oxidation catalyst. After the combustion has been initiated and the combustion chamber and catalyst have been heated up, steady-state combustion can be continued at a temperature significantly lower than the light-off temperature. The preferred means of preheating the gas stream, either together with or in the absence of the air for combustion, is by heat exchange with the hot combusted gas stream exiting from the first combustion stage.

The temperature of the combusted gas stream available for preheating the feed gas is dependent on a number of factors including the heating value of the gas stream undergoing combustion, the amount of air that is used for combustion and the temperature to which the feed gas stream is preheated. The temperature to which the gas is preheated is not critical other than it be sufficiently high to support combustion under the particular conditions involved. The pressure present in the combustion zones also is not critical, varying from about atmospheric up to about 2,000 psi, more generally up to about 500 psi.

The oxidation catalysts that are used in our substoichiometric combustion process are desirably carried on an inert support. Since the catalytic combustion inherently involves a relatively large volume of the stream of low heating value gas, the support is preferably of a design to permit good solid-gas contact at relatively low pressure drop. A suitable support can be formed as a monolith with hexagonal cells in a honeycomb design. Other cellular, relatively open-celled designs or similar structures having a relatively high void volume are also suitable. It is also possible to use a catalyst bed comprising spheres, extrudates or similar shapes as the catalyst support provided that the pressure drop across the catalyst bed is not too large.

The support for the catalysts to be used in the process of this invention can be any of the refractory oxide supports well known in the art, such as those prepared from alumina, silica, magnesia, thoria, titania, zirconia, silica-aluminas, silica-zirconias, magnesia-aluminas, and the like. Other suitable supports include the naturally occurring clays, such as diatomaceous earth. Additional desirable supports for use herein are the more recently developed corrugated ceramic materials made, for example, from alumina, silica, magnesia, and the like. An example of such material is described in U.S. Pat. No. 3,255,027 and is sold by E. I. duPont de Nemours & Company as "Torvex". More recently metallic monoliths have been fabricated as catalyst supports and these may be used to mount the catalytic material. An example of these supports is Fecralloy manufactured by Matthey Bishop, Inc. under U.S. Pat. Nos. 3,298,826 and 3,920,583.

If desired, the catalyst and solid cocatalyst, if used, can be mounted directly onto the surface of the monolith. Or the monolith can first be coated with a refractory oxide, such as defined above, prior to the deposition of these materials. The addition of the refractory oxide coating allows the catalyst to be more securely bound to the monolith and also aids in its dispersion on the support. These coated monoliths possess the advantage of being easily formed in one piece with a configuration suitable to permit the passage of the combustion gases with little pressure drop. The surface area of the monolith generally is less than one square meter per gram. However, the coating generally has a surface area of between about ten and about 300 $m^2/g$. Since the coating is generally about ten percent of the coated support, the surface area of the coated support will therefore generally be between about one and about 30 $m^2/g$.

In preparing the platinum and solid cocatalyst combination it is preferred that the cocatalyst be placed on the support before the platinum. However, the reverse order of emplacement is also suitable or the platinum and solid cocatalyst can be added in a single step. In the preferred procedure a suitable salt of the cocatalyst metal is dissolved in a solvent, preferably water. The support is impregnated with the solution of the cocatalyst metal. In a preferred embodiment the impregnated support is next gassed with a suitable gas, generally ammonia or hydrogen sulfide, to cause the catalyst metal to precipitate uniformly on the support as the hydroxide or sulfide as the case may be. It is then dried and calcined in air at about 800° to 1200° F., preferably at about 1000° F. Hydrogen may be used to reduce the cocatalyst compound to the metal if desired.

Platinum is impregnated onto the support, either alone or in association with a solid cocatalyst as an aqueous solution of a water-soluble compound such as chloroplatinic acid, ammonium chloroplatinate, platinum tetramine dinitrate, and the like. The composite is then gassed with hydrogen sulfide in a preferred embodiment to cause precipitation of the platinum as the sulfide to ensure uniform distribution of the platinum on the support. It is again dried and then calcined in air at about 800° to 1200° F., preferably at about 1000° F. The same general procedure can be used for the incorporation of a different oxidation catalyst on the support. In general, it is not certain whether calcination converts the catalyst metal sulfides and hydrated sulfides to another compound or how much is converted to the oxide, sulfite or sulfate, or to the metal itself. Nevertheless, for convenience, the noble metals such as platinum are reported as the metal and the other catalyst metals are reported as the oxide.

DESCRIPTION OF PREFERRED EMBODIMENTS

The reactor used in the following experiments at atmospheric pressure was a one-inch I.D. forged steel unit which was heavily insulated to give adiabatic reaction conditions. The reactor used in the combustion under pressure was made from Incoloy 800 alloy (32 percent Ni, 46 percent Fe and 20.5 percent Cr) but was otherwise the same. Well insulated preheaters were used to heat the gas stream before it was introduced into the reactor. The temperatures were measured directly before and after the catalyst bed to provide the inlet and outlet temperatures. An appropriate flow of preheated nitrogen and air was passed over the catalyst until the desired feed temperature was obtained.

Preheated hydrocarbon was then introduced at a gas hourly space velocity of 42,000 per hour on an air-free basis and combustion was allowed to proceed until steady state conditions were reached. The feed gas stream contained 94.5 mol percent nitrogen, 3.75 mol percent methane, 0.98 mol percent ethane, 0.77 mol percent propane and 400 ppm hydrogen sulfide, except where otherwise noted. The heating value of this feed stream is about 75 Btu/scf. The experiments were conducted at atmospheric pressure. The catalyst compositions are only approximate because they are based on an analysis of the decrease in the metals content of the impregnating solutions and not on a complete chemical analysis of the finished catalyst. The analyses were made on a water-free basis after steady state conditions were reached. The conversion is the overall conversion of all hydrocarbon constituents. No measurable free oxygen occurred in the product gas stream.

EXAMPLE 1

A catalyst was prepared containing about 0.5 percent platinum on a Torvex monolith as the support. The Torvex support was a mullite ceramic in the shape of a honeycomb having a coating of alumina of about 25 $m^2/g$ surface area. The catalyst consisted of three one-inch monoliths wrapped in a thin sheet of a refractory material (Fiberfrax, available from Carborundum Co.). This catalyst was used in a series of air equivalence ratios (A.E.R.) The results of the runs are set out in Table I.

TABLE I

| Run | AER | Temperature, °F. Inlet | Outlet | CO Mol % | $CO_2$ Mol % | $CO/CO_2$ | Conv. % |
|---|---|---|---|---|---|---|---|
| 1 | 0.2 | 650 | 910 | 0.03 | 1.34 | 0.02 | 21.2 |
| 2 | 0.3 | 650 | 1033 | 0.52 | 1.62 | 0.32 | 39.0 |
| 3 | 0.4 | 650 | 1123 | 1.54 | 1.41 | 1.09 | 38.1 |
| 4 | 0.5 | 650 | 1198 | 2.45 | 1.39 | 1.76 | 61.8 |
| 5 | 0.6 | 650 | 1285 | 2.85 | 1.59 | 1.79 | 76.3 |
| 6 | 0.7 | 650 | 1396 | 2.68 | 2.14 | 1.25 | 90.5 |
| 7 | 0.8 | 650 | 1605 | 0.71 | 4.03 | 0.18 | — |

EXAMPLE 2

The next series of runs was carried out using a catalyst containing about 0.3 percent platinum on a Torvex monolith support in the manner as described in the preceding example. The results of this run are set out in Table II.

TABLE II

| Run | AER | Temperature, °F. Inlet | Outlet | CO Mol % | $CO_2$ Mol % | $CO/CO_2$ | Conv. % |
|---|---|---|---|---|---|---|---|
| 8[a] | 0.2 | 700 | 943 | 0.14 | 1.28 | 0.11 | 19.3 |
| 9 | 0.3 | 650 | 1062 | 0.45 | 1.66 | 0.27 | 23.3 |
| 10 | 0.4 | 650 | 1148 | 1.17 | 1.69 | 0.69 | 42.1 |
| 11[a] | 0.5 | 650 | 1236 | 1.94 | 1.66 | 1.17 | 57.3 |
| 12 | 0.6 | 650 | 1315 | 2.42 | 1.79 | 1.35 | 71.4 |
| 13[a] | 0.7 | 650 | 1415 | 2.11 | 2.43 | 0.87 | 81.5 |
| 14 | 0.8 | 650 | 1596 | 0.75 | 4.03 | 0.19 | — |

[a]Average of 2 runs on different days.

EXAMPLE 3

Another series of runs was carried out using a catalyst containing 0.5 percent platinum as described in Example 1. In this experiment the amount of hydrogen sulfide was varied for each run to determine the effect of hydrogen sulfide in the feed stream on the light-off temperature (L.O.T.), on the overall conversion and on the product composition. These runs were carried out at an air equivalence ratio of 0.6. The results are set out in Table III.

TABLE III

| Run | $H_2S$, ppm | Temperature, °F. L.O.T. | Outlet | CO Mol % | $CO_2$ Mol % | Conv. % |
|---|---|---|---|---|---|---|
| 15 | 0 | 435 | 1144 | 2.78 | 2.14 | 83.0 |
| 16 | 200 | 435 | 1198 | 2.01 | 2.00 | 65.7 |
| 17 | 400 | 475 | 1224 | 1.97 | 1.96 | 66.0 |
| 18 | 2,000 | 480 | 1234 | 1.49 | 2.27 | 59.3 |
| 19 | 4,000 | 581 | 1263 | 1.46 | 2.09 | 56.9 |
| 20 | 10,000 | 740 | 1504 | 1.55 | 1.75 | 51.4 |

The data in Table III shows that hydrogen sulfide in the feed gas causes the hydrocarbon conversion to decrease with the trend being a reciprocal relationship. The presence of hydrogen sulfide in the feed gas also causes the light-off temperature to increase with the increase starting in the specific example at a hydrogen sulfide content between 200 and 400 ppm. But the presence of hydrogen sulfide not only causes an overall reduction in carbon monoxide content in the product gas of the present example from 2.78 to 1.55 mol percent, but is also causes a reduction in the ratio of carbon monoxide to carbon dioxide, that is, from 1.3:1 to 0.89:1 as determined from runs 15 and 20 in the table.

EXAMPLE 4

Several experiments were carried out to compare the light-off temperature of the 0.5 percent platinum catalyst as described in Example 1 with the 0.3 percent platinum catalyst as described in Example 2 at a space velocity of 42,000 per hour and a hydrogen sulfide content of 400 ppm in the feed gas. The results are set out in Table IV.

TABLE IV

| AER | Light-off temperature, °F. 0.5 Pt | 0.3 Pt |
|---|---|---|
| 0.2 | 650 | 700 |
| 0.6 | 480 | — |
| 0.7 | — | 515 |

The information obtained from these experiments is described as it might be used in an integrated tertiary oil recovery operation by in situ combustion according to the following example.

EXAMPLE 5

An in situ fire flood is initiated in an oil zone in an underground petroleum reservoir at an overall depth of about 6,000 feet. Oil production from the formation had been exhausted following secondary recovery by water injection. The fire is initiated in the formation and steady state conditions are reached in about 10 weeks. At this time about 9.1 million scf per day of air at a temperature of about 200° F. and a pressure of about 3,800 psi are pumped into the injection well by a multistage compressor, which is driven by a gas turbine. The combusted gas and entrained hydrocarbon liquids are produced in adjacent production wells. The entrained liquids are removed in a separator resulting in about 7.5 million scf per day of liquid-free, waste flue gas of low heat content. The temperature of this flue gas is about 95° F. and its gauge pressure is about 150 psig. Its average analysis over a 19-day period is about 2.2 percent methane, about 0.5 percent ethane, about 0.4 percent propane, about 0.3 percent butane, about 0.25 percent pentanes, about 0.2 percent hexanes and higher, about 500 ppm sulfur, about 15 percent carbon dioxide, about one percent argon and the remainder nitrogen. Its average heat content for this 19-day period is about 78 Btu/scf with a maximum value of about 91 and a minimum value of about 61 during this period.

This flue gas is combusted in two stages. The catalyst in the first stage is a monometallic platinum oxidation catalyst comprising about 0.5 percent platinum on an alumina-coated Torvex monolithic ceramic support. The catalyst in the second stage is a bimetallic oxidation catalyst comprising about one percent cobalt oxide and about 0.3 percent platinum impregnated on the same support as used in the first stage. Over this 19-day period under study the flue gas is combusted by the injection of a constant amount of air, approximately equally divided between the input to each combustion stage, to provide an average air equivalence ratio of about 0.64. As a result the combustion is substoichiometric over the entire 19-day period. The flue gas-air mixture is heated above its ignition temperature by heat exchange with the combusted gas from the first stage before it is introduced into the first combustor. The combusted flue gas is mixed with the second portion of combustion air after the heat exchanger and prior to entering the second combustor. The gas stream leaving the second combustor has a temperature of about 1,550° F. This hot gas stream is used to drive the gas turbine which is designed for an operating temperature of 1,450° F. Therefore, a sufficient quantity of the 200° F. compressed air is bled from the compressed air line and injected into the combusted flue gas prior to the turbine inlet to drop its temperature to about 1,450° F. The combusted flue gas is introduced into the turbine at a gauge pressure of about 90 psia and exits at near atmospheric pressure. Since the first combustor used the bimetallic catalyst, the turbine exhaust contains less than one percent carbon monoxide permitting it to be vented directly to the atmosphere.

The pressure of the air injected into subterranean deposits of carbonaceous materials will vary over a wide range, such as about 500 psi to about 5,000 psi or even wider. The actual pressure used depends on many factors including the depth and down-hole pressure in the formation, the permeability of the formation, the distance between the injection and producing holes, and the like. In any particular recovery operation utilizing in situ combustion the injection pressure limits are a minimum pressure sufficient to obtain adequate flow of gas through the formation and a maximum pressure less than the amount which would crack the formation and permit the air to bypass the combustion zone. There will generally be a substantial diminution of the gas pressure between the injection and production wells, the amount depending on the many variables inherent in the characteristics of the formation as well as the variables in the operating procedures. In order to effectively carry out an integrated operation in which the flue gas under pressure is combusted and used to drive a gas turbine, as described herein, it is desirable that the recovered flue gas possess a pressure of at least about 75 psi.

As stated, the heating value of the low heating value gas that is to be combusted by our process may vary with time. In the combustion of such a gas of varying heating value with a constant stream of combustion air for the purpose of driving a gas turbine, it is preferred that the air equivalence ratio be so selected that there is not a substantial excess of oxygen at any specific period of operation, i.e., at a period of low heating value, in order to ensure that during this period there is not a substantial drop in temperature of the combusted gas that is fed to the turbine. If the variations in heating value over a period of time exhibit a substantial swing between the minimum and maximum values, it may be expedient to inject supplemental fuel into the feed gas stream during minimum values to decrease the extent of the negative swing rather than use an average A.E.R. that is too low for efficient utilization of the heat energy in the low heating value gas.

In using the low heating value gas to drive a gas turbine, the combusted gas must enter the gas turbine at a sufficient pressure for satisfactory operation of the gas turbine. In general, an inlet pressure of at least about 75 psi or higher is desirable. This pressure can be obtained, if necessary, by compressing the gas fed to the combustion furnace. A gas turbine can be operated at a temperature as low as about 1,000° F. or even lower, but since turbine efficiency exhibits a significant drop at the lower temperatures, it is preferred to operate at a temperature at which significant efficiency is obtained, and particularly a temperature of at least about 1,200° F. The maximum temperature is determined by the temperature resistance of the materials from which the turbine is constructed and can be about 2,000° F. or even higher particularly if the compressor is designed with provision for auxiliary cooling, but it is preferred that the maximum operating temperature be about 1,800° F. Generally, a large capacity turbine of the type which would be used with large gas volumes is designed for optimum operation within a specific restricted temperature range.

In the two-stage combustion procedure, it is desirable if at least about one-third of the total air which is to be used in the substoichiometric combustion be added in one combustor, and it is generally preferred that about one-half of this combustion air be added in each combustor. This ability to vary the amount of combustion air added to the first combustor permits the temperature of the gas stream entering the first stage reactor, following heat exchange with the combusted gas from the first stage, to be varied. This air that is used for combustion of the gas, as well as any air that may be used for cooling the combusted gas down to the desired turbine operating temperature, needs to have a pressure only moderately higher than the pressure of the gas streams into which it is injected.

It is to be understood that the above disclosure is by way of specific example and that numerous modifications and variations are available to those of ordinary skill in the art without departing from the true spirit and scope of the invention.

We claim:

1. The in situ combustion process for recovering liquid hydrocarbons from subterranean formations which comprises injecting a stream of combustion air into at least one injection well leading to a combustion zone in said subterranean formation, producing liquid hydrocarbons and combustion gas from at least one production well, separating the liquid hydrocarbons from the stream of combustion gas whereby a separated stream of flue gas is obtained having a heating value between about 15 Btu/scf and about 200 Btu/scf and containing at least one aliphatic hydrocarbon having from one to about seven carbon atoms, passing said flue gas stream admixed with air for combustion through two combustion zones in series comprising a first combustion zone and a second combustion zone in contact with an oxidation catalyst in the first combustion zone comprising from about 0.2 to about ten weight percent platinum on an inert support and in contact with an oxidation catalyst in the second combustion zone comprising from about 0.05 to about five weight percent platinum on an inert support, the ratio of the concentration of platinum on said oxidation catalyst in the first combustion zone to the concentration of platinum on said oxidation catalyst in the second combustion zone being between about 1.2:1 and about 20:1, at a temperature in each combustion zone which is high enough to initiate and maintain combustion of said gas stream, the total amount of combustion air being sufficient to provide an overall air equivalence ratio between about 0.30 and about 0.80, expanding the gas stream in a gas turbine following said catalyzed combustion, and driving an air compressor with said gas turbine to compress and inject said stream of combustion air into the said subterranean combustion zone.

2. A substoichiometric combustion process for the recovery of energy from a gas stream having an average heating value in the range of about 15 to about 200 Btu/scf and having a combustible component comprising one or more hydrocarbons having from one to about seven carbon atoms, carbon monoxide or mixtures thereof and up to about 50 mol percent hydrogen which comprises the steps (a) passing said gas stream admixed with a substoichiometric quantity of air for combustion through a first combustion zone in contact with a first oxidation catalyst comprising between about 0.2 and about ten weight percent platinum on an inert support at a temperature sufficient to initiate and maintain combustion of said gas, (b) passing the partially combusted gas stream from the first combustion zone admixed with a further substoichiometric quantity of air for combustion through a second combustion zone in contact with a second oxidation catalyst comprising between about 0.05 and about five weight percent platinum on an inert support at a temperature sufficient to initiate and maintain combustion of said gas, the ratio of the concentration of platinum on said first oxidation catalyst to the concentration of platinum on said second oxidation catalyst comprising between about 1.2:1 and about 20:1, the total amount of air used for combustion in said first and second combustion zones providing an overall air equivalence ratio of between about 0.30 and about 0.80, and utilizing the heat energy produced in the gas stream exiting from said second combustion zone.

3. The process in accordance with claims 1 or 2 in which the stream of low heating value gas undergoing substoichiometric combustion contains between about 400 ppm and about two weight percent hydrogen sulfide.

4. The process in accordance with claims 1 or 2 in which said second oxidation catalyst comprises in addition to said platinum a metal oxide cocatalyst selected from Groups IIA and VIIB, Group VIII up through atomic No. 46, the lanthanides, chromium, zinc, silver, tin and antimony.

5. The process in accordance with claims 1 or 2 in which said first oxidation catalyst comprises a concentration of platinum of between about 0.5 and about five percent, said second oxidation catalyst comprises a concentration of platinum of between about 0.1 and about one percent, and the ratio of the concentration of platinum in said first oxidation catalyst to the concentration of platinum in said second oxidation catalyst is between about 1.5:1 and about 10:1.

6. The process in accordance with claims 1 or 2 in which the stream of low heating value gas undergoing substoichiometric combustion contains between about 0.1 and about 0.5 weight percent hydrogen sulfide.

* * * * *